US006183320B1

(12) United States Patent
Natsume

(10) Patent No.: US 6,183,320 B1
(45) Date of Patent: Feb. 6, 2001

(54) TILT MECHANISM FOR MARINE OUTBOARD DRIVE

(75) Inventor: Noriyuki Natsume, Shizuoka (JP)

(73) Assignee: Sanshin Kogyo Kabushiki Kaisha (JP)

( * ) Notice: Under 35 U.S.C. 154(b), the term of this patent shall be extended for 0 days.

(21) Appl. No.: 09/385,177

(22) Filed: Aug. 30, 1999

(30) Foreign Application Priority Data

Sep. 7, 1998 (JP) ..... 10-252989

(51) Int. Cl.[7] ..... B63H 5/125
(52) U.S. Cl. ..... 440/53; 440/61
(58) Field of Search ..... 440/53, 61, 58–60, 440/900; 123/195 P; 248/640–643

(56) References Cited

U.S. PATENT DOCUMENTS 5,529,519 * 6/1996 Nakamura et al. ..... 440/61

* cited by examiner

*Primary Examiner*—Ed Swinehart
(74) *Attorney, Agent, or Firm*—Knobbe, Martens, Olson & Bear, LLP

(57) ABSTRACT

A tilt mechanism for a marine outboard drive includes a hydraulic cylinder assembly disposed transversely offset from the center axis of the tilt mechanism. The tilt mechanism includes a swivel bracket carrying a drive unit for pivotal movement about a generally vertically extending steering axis and a clamping bracket supporting the swivel bracket for pivotal movement about a generally horizontally extending tilt axis. The swivel bracket has wall portions transversely extending from the steering axis. One of the wall portions positioned nearer to the hydraulic cylinder assembly is reinforced greater than the other wall portion. Also, the clamping bracket comprises a pair of spaced members. One of the spaced members positioned nearer to the hydraulic cylinder assembly is reinforced greater than the other spaced member.

11 Claims, 8 Drawing Sheets

TILT MECHANISM FOR MARINE OUTBOARD DRIVE

BACKGROUND OF THE INVENTION

1. Field of the Invention

This invention relates to a trim and/or tilt mechanism for a marine outboard drive and more particularly to an improved trim and/or tilt mechanism that includes a hydraulic cylinder device disposed transversely offset from the center axis of the mechanism per se.

2. Description of Related Art

As an example of the marine outboard drive, generally an outboard motor has a drive unit mounted on an associated watercraft by means of a trim and/or tilt mechanism which comprises a swivel bracket and a clamping bracket. The swivel bracket carries the outboard drive unit for pivotal movement about a generally vertically extending steering axis. The clamping bracket, in turn, is affixed to the transom of an associated watercraft with a pair of horizontally spaced members and supports the swivel bracket for pivotal movement about a generally horizontally extending tilt axis.

The trim and/or tilt mechanism includes also a hydraulic cylinder assembly disposed between the swivel bracket and the clamping bracket so that the swivel bracket as well as the drive unit is tilted up or down relative to the clamping bracket and eventually to the transom of the associated watercraft. The fluid motor is, for example, a compound trim and tilt hydraulic cylinder device. An exemplary hydraulic cylinder device is shown in the U.S. Pat. No. 5,718,613.

The hydraulic cylinder device includes an outer cylinder housing, a tilt cylinder slidably supported in the outer cylinder housing, a tilt piston slidably supported in the tilt cylinder and a piston rod affixed to the tilt piston at its one end and extending outwardly from both of the tilt cylinder and the outer cylinder housing. The other end of the piston rod is pivotally connected to the swivel bracket, while the outer cylinder housing is also pivotally connected to the clamping bracket. Hydraulic fluid is contained in the cavities formed in the cylinder housing and also the tilt cylinder and pressurized selectively by a powering assembly to move the piston rod either one of the expanding direction or contracting direction.

By this selective movement of the piston rod, the drive unit can be lifted up or lowered down. If an operator of the outboard motor wishes to adjust the trim angle of the drive unit, the operator operates the hydraulic cylinder device within a trim range. During this trim range operation, the tilt cylinder acts as a trim piston and moves relatively slow but produces large force. Meanwhile, if the operator wishes to tilt up or down the drive unit, he or she operates the hydraulic cylinder device within a tilt range. In this range, the tilt piston moves and this time relatively quick but produces small force.

As described above, the mechanism will operate as a trim and tilt mechanism with this hydraulic cylinder device. Some mechanism, however, is provided with either a trim cylinder device or a tilt cylinder device. Thus, the term "tilt mechanism" will mean not only the tilt mechanism per se but also the trim and tilt mechanism and even a single trim mechanism in the broad sense hereunder wholly through this specification including claims unless depicted otherwise.

The powering assembly comprises a reversible electric motor, a reversible hydraulic pump driven by the electric motor and a fluid reservoir. In order to minimize the size of the tilt mechanism, usually the powering assembly is placed between the spaced members of the clamping bracket side by side with the hydraulic cylinder device. Since the place for the hydraulic cylinder device and the powering assembly is not so spacious, it means that the hydraulic cylinder device must be decentered transversely from the axis of the tilt mechanism. This arrangement gives rise to a problem.

That is, the lifting or lowering force exerted onto the piston rod and the outer cylinder housing affects the swivel bracket and the clamping bracket as an offset load and this offset load is likely to deform the bracket assembly. If the brackets have sufficient thickness entirely, rigidity will be enough. However, this resolution apparently increases the whole weight of the bracket assembly.

It is, therefore, a principal object of this invention to provide an improved tilt mechanism to solve the problem.

It is another object of this invention to provide a tilt mechanism that will hardly cause such a deformation in its bracket assembly without having futile weight.

SUMMARY OF THE INVENTION

In accordance with one aspect of this invention, a tilt mechanism for a marine outboard drive comprises a swivel bracket. The swivel bracket carries a drive unit for pivotal movement about a generally vertically extending steering axis. The swivel bracket has wall portions extending generally transversely at both sides of the steering axis. The tilt mechanism also includes a clamping bracket. The clamping bracket supports the swivel bracket for pivotal movement about a generally horizontally extending tilt axis. The clamping bracket has a pair of transversely spaced members adapted to be affixed to the transom of an associated watercraft. The wall portions of the swivel bracket are at least partially capable to be fitted between the spaced members. The tilt mechanism further comprises a hydraulic cylinder assembly. The hydraulic cylinder assembly is capable to expand and contract along its longitudinal axis. The hydraulic cylinder assembly has a pair of end portions. One of the end portions is pivotally connected to the swivel bracket and the other one of the end portions is pivotally connected to the clamping bracket. The hydraulic cylinder assembly is biased to one of the transversely spaced members. At least one of the wall portions and the transversely spaced members positioned nearer to the hydraulic cylinder assembly is reinforced greater than the other one of the wall portions and the transversely spaced members.

In accordance with another aspect of this invention, a tilt mechanism for a marine outboard drive comprises a swivel bracket. The swivel bracket carries a drive unit for pivotal movement about a generally vertically extending steering axis. The tilt mechanism also comprises a clamping bracket. The clamping bracket supports the swivel bracket for pivotal movement about a generally horizontally extending tilt axis. The clamping bracket has a pair of transversely spaced members adapted to be affixed to the transom of an associated watercraft. The tilt mechanism further comprises a hydraulic cylinder assembly. The hydraulic cylinder assembly is capable to expand and contract along its longitudinal axis. The hydraulic cylinder assembly has a pair of end portions. One of the end portions is pivotally connected to the swivel bracket and the other one of the end portions is pivotally connected to the clamping bracket. The hydraulic cylinder assembly is disposed between the transversely spaced members and biased to one of the transversely spaced members. Each of the transversely spaced members includes a foot section being capable to be seated at the transom of the associated watercraft. Each of the transversely spaced members also includes a standing section extending from the foot portion. The respective standing sections have bores. A pivot shaft of the other one of the end portions of the hydraulic cylinder assembly is journaled in the bores. The other one of the end portions of the hydraulic cylinder assembly is disposed on the pivot shaft at generally directly next to one of the transversely spaced members. The reminder of space on the pivot shaft is balanced with a collar.

Further aspects, features and advantages of this invention will become apparent from the detailed description of the preferred embodiments which follow.

DETAILED DESCRIPTION OF THE PREFERRED EMBODIMENT OF THE INVENTION

Figure 1:
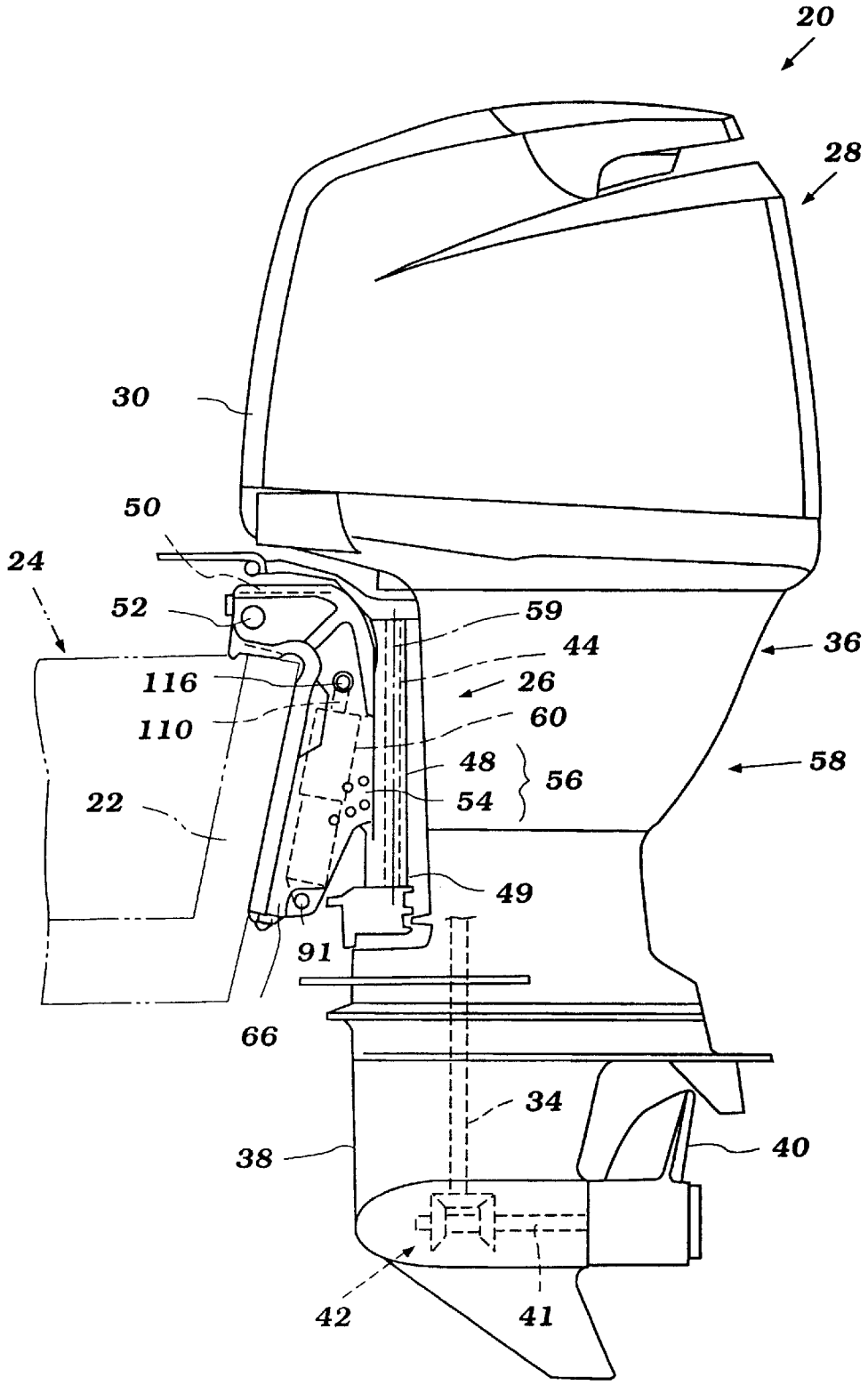
FIG. 1 is a side elevational view showing an outboard motor embodying features of this invention as attached to the trnsom of an associated watercraft shown partially in phantom.

Referring now in detail to FIGS. 1 through 10 which illustrate an embodiment of this invention and initially to FIG. 1, an outboard motor is identified generally by the reference numeral 20. The outboard motor 20 is shown as attached to a transom 22 of an associated watercraft 24 that is shown partially. A hydraulic trim and tilt adjustment mechanism is identified generally by the reference numeral 26 and will be described more in detail with reference to FIGS. 2 through 10 later.

Although the invention is described in conjunction with the outboard motor 20, it should be readily apparent that the invention is susceptible of use with other types of outboard drives such as the outboard drive portion of an inboard, outboard drive. It is believed that other usages will be readily obvious to those skilled in the art.

The outboard motor 20 includes a power head 28 which comprises a powering internal combustion engine (not shown) and a surrounding protective cowling 30. As is typical with outboard motor practice, the engine of the power head 28 is supported so that its output shaft rotates about its vertically extending axis and drive a driveshaft 34 that is journaled within a driveshaft housing 36. The driveshaft 34 extends through the driveshaft housing 34 and into a lower unit 38 and there drives a propulsion device such as a propeller 40 affixed on a propeller shaft 41 through a conventional forward/neutral/reverse transmission 42.

A steering shaft 44 is affixed to a driveshaft housing 36 and is supported for steering movement within a swivel bracket 48 in a known manner. The steering shaft 44 is accommodated in a steering shaft holder portion 49 of the swivel bracket 48. The swivel bracket 48 has a forwardly extending portion 50 that is connected by means of a pivot pin 52 to a clamping bracket 54. Thus, the swivel bracket 48 carries the drive unit 58 for pivotal movement about a generally vertically extending steering axis 59 of the steering shaft 44, while the clamping bracket 54 supports the swivel bracket 48 for pivotal movement about a generally horizontally extending tilt axis of the pivot pin 52. The clamping bracket 54 is detachably affixed to the transom 22 in a manner that will be described shortly. The swivel bracket 48 and the clamping bracket 54 define a bracket assembly 56.

The power head 28, the driveshaft housing 36 and the lower unit 38 except for the bracket assembly 56 define a drive unit 58. The pivotal connection 52 between the clamping bracket 54 and the swivel bracket 48 permits the drive unit 58 to be moved through a trim adjusted range that exists between the fully trimmed down position to the flully trimmed up position. In addition, the drive unit 58 may be swung through a remaining range to a tilted up out of the water position about the pivot pin 52. A hydraulic tilt and trim cylinder assembly or device 60 is provided for effecting these movements and other movements such as a pop up movement when an underwater obstacle is struck to the drive unit 58.

Figure 2:
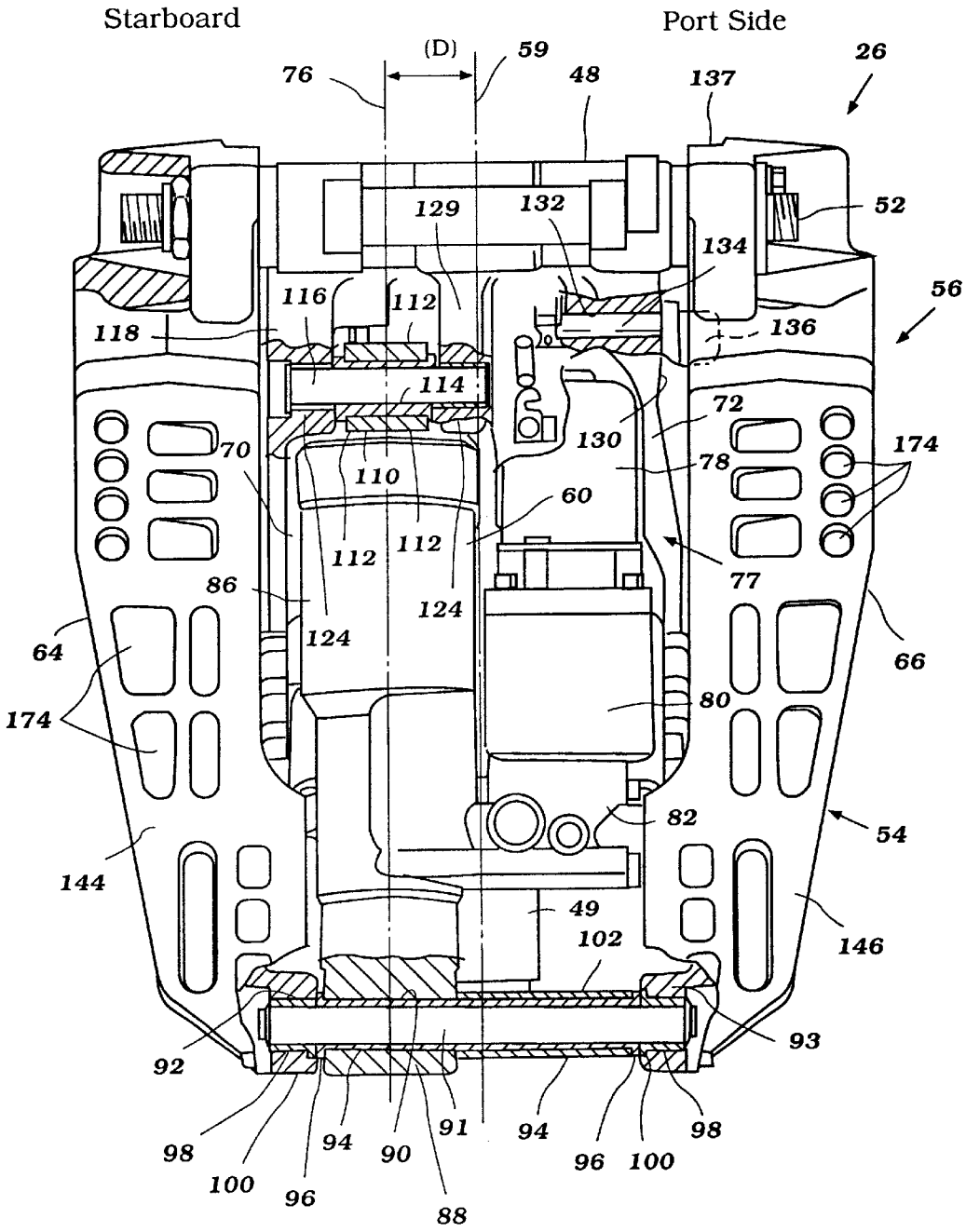
FIG. 2 is an enlarged front elevational view of a tilt mechanism constructed in accordance with an embodiment of this invention. Some portions are shown in cross-section.

The cramping bracket 54 actually comprises a pair of transversely spaced apart side members 64, 66 that are mounted on the rear of the transom 22. The side member 64 is located at the starboard, while the other side member 66 is located on the port side. The swivel bracket 48 is interposed between them. That is, the swivel bracket 48 has wall portions 70, 72 that extend generally transversely at both sides of the steering shaft holder portion 49. The forwardly extending portion 50 is bound up with these wall portions 70,72 at the top of the swivel bracket 48. The steering shaft 44 has the aforenoted steering axis 59. This axis 59 is consistent with the center axis of the hydraulic trim and tilt adjustment mechanism 26 in the front view as shown in FIG. 2. Thus, the center axis of the tilt mechanism 26 will be indicated with the same reference numeral 59 hereunder.

The hydraulic trim and tilt cylinder assembly 60 is nested between the side members 64, 66 but positioned transversely offset from the steering or center axis 59 toward the starboard side member 64. The center axis 76 of the cylinder assembly 60 is, thus, located apart from the center axis 59 with the distance (D). The reminder of the space is occupied generally by a powering assembly 77 so that both of the hydraulic cylinder assembly 60 and the powering assembly 77 are disposed side by side. That is, the hydraulic cylinder assembly 60 occupies almost the half space that extends at the starboard side from the center axis 59 and the powering assembly 77 occupies the other half space that extends on the port side from the axis 59.

The hydraulic cylinder assembly 60 forms an integral part with the powering assembly 77. The powering assembly 77 includes a reversible electric motor 78 at its upper end. A reversible hydraulic pump 80 is disposed below the electric motor 78. A fluid reservoir 82 is also disposed beneath the pump 80 and contains hydraulic working fluid for the system. In addition, a suitable valve assembly may be incorporated within the pump 80 and the reservoir 82 so as to provide normal pressure relief functions and directional control of the hydraulic cylinder assembly 60.

The hydraulic cylinder assembly 60 includes an outer cylinder housing 86 having a trunion portion 88 with a bore 90 so as to receive a lower pin 91 for providing a pivotal connection to the clamping bracket 54 and specifically the side members 64, 66 thereof. Bores 92, 93 of the side members 64, 66 receive the lower pin 91. A pair of bushes 94 are fitted around the lower pin 91. The bushes 94 are separated at the center axis 59 from each other and each has a flange 96 at the outer side. The bushes 94 are made of metal such as, for example, stainless steel (SUS). Meanwhile, another pair of bushes 98 are provided around and at both sides of the lower pin 91 to be fitted into the bores 92, 93 of the side members 64, 66. Each of these bushes 98 have a flange that meets with the respective flanges 96 of the bushes 94. The bushes 98 are also made of metal such as, for example, stainless steel (SUS). Thus, the lower pin 91 is journaled by the side members 64, 66 and pivotally supports the trunion 88 of the cylinder housing 86. A collar 102 is fitted around the outer side of one of the bushes 94 so as to balance the distance between the trunion 88 of the cylinder housing 86 and the side member 66 located on the port side. In other words, the trunion 88 is accurately positioned on the lower pin 91 with the collar 102 and the flange 96 of the bush 94. Because of this arrangement, no rattling of the outer housing 86 is produced.

As described above, since the metal bushes 94, 98 are fitted around the lower pin 91, the pin 91 is reinforced against the bending force exerted thereon in the decentered arrangement of the hydraulic cylinder assembly 60.

Although any internal arrangement is available, the hydraulic cylinder assembly 60 in this embodiment is a compound or telescopic trim and tilt cylinder device that is conventional and it is, for example, disclosed in the U.S. Pat. No. 5,718,613 as aforenoted. The hydraulic cylinder device 60 contains a tilt cylinder slidably supported in a cavity of the outer cylinder housing 86, a tilt piston slidably supported in a cavity of the tilt cylinder and a piston rod 110 affixed to the tilt piston at its one end and extending outwardly from both of the tilt cylinder and the outer cylinder housing 86.

The tilt piston has valving passages for effecting, for example, a shock absorbing function in case of an abrupt hit to the drive unit 58 by an underwater obstacle. Also, the outer cylinder housing 86 has a passage that connects via the powering assembly 77 upper and lower chambers formed in the cavity and generally divided by the tilt piston. The passage is formed at a wall portion of the outer housing 86. Working fluid pressurized by the powering assembly 77 will be supplied through the passage to the upper and lower chambers to move the tilt piston. This causes the expanding and contracting movements of the piston rod 110.

The piston rod 110 has a trunion portion 112 with a bore 114 that receives an upper pin 116 for providing a pivotal connection to the swivel bracket 48 and specifically a pair of spaced portions 118 and 120 thereof A pair of bushes 122, which have configurations similar to the bushes 94 are inserted between the upper pin 116 and the bore 114 of the trunion 112. Another pair of bushes 124, which have configurations similar to the bushes 98 are also inserted between the upper pin 116 and bores of the spaced portions 118, 120. These bushes 122, 124 can be made of, for example, metal or synthetic resin.

With the aforedescribed connections, when the piston rod 110 expands outwardly from the outer cylinder housing 86, the swivel bracket 48 and also the drive unit 58 supported by the swivel bracket 48 are lifted up within the trim adjusted range and further the tilt range. Also, when the piston rod 110 contacts into the outer housing 86, the swivel bracket 48 as well as the drive unit 58 are lowered down within the same ranges.

The hydraulic tilt cylinder assembly 60 is decentered and more specifically disposed transversely offset from the center axis 59 of the hydraulic tilt adjustment mechanism 26 as described above. In other words, the hydraulic tilt cylinder assembly 60 is biased to a starboard side member 64. Due to this arrangement, the lifting or lowering force exerted onto the piston rod 110 and the outer cylinder housing 86 affects the swivel bracket 48 and the clamping bracket 54 as an offset load. This offset load is likely to deform the bracket assembly 56.

In order to avoid the deformation, the bracket assembly 56 has improved configurations. These configurations will now be described with reference to FIGS. 2 through 10.

Firstly, the port side wall portion 72 of the swivel bracket 48, which is positioned farther from the hydraulic cylinder assembly 60 than the starboard side wall portion 70, has a recess 130 at its transverse end. This means that the starboard side wall portion 70 is reinforced greater than the port side wall portion 72. At this port side wall portion 72, a bore 132 is provided. A tilt stop lever 134 is pivotably inserted into this bore 132 and its head portion 136 is positioned in the recess 130. This tilt stop lever 134 is conventional and for holding the drive unit 58 at the fully tilted up position mechanically by positioned at a step portion 137 formed at the top of the side member 66. Thus, the recess 130 contributes not only for reinforcement of the starboard side wall portion 70 relative to the port side wall portion 72 but also for compactness of the hydraulic tilt mechanism 26. In addition, the port side wall portion 72, conversely, has a weight lighter than a weight of the starboard side wall portion 70. This contributes to reduce the whole weight of the swivel bracket 48.

Another improvement exists in configurations of the side members 64, 66 of the clamping bracket 54.

The respective side members 64, 66 are configured generally as a L-shape in a side elevational view as seen in FIGS. 3, 4, 7 and 8. That is, the upper portions in proximity to bores 140, 142, through which the pivot pin 52 extends, are curved to make a generally right angle. The respective side members 64, 66 have foot sections 144, 146, with which the side members 64, 66 are seated at the transom 22 of the associated watercraft 24. The respective side members 64, 66 have also standing sections 148, 150 that extend from the foot sections 144, 146. The foot sections 144, 146 extend simply outwardly. That is, transverse cross-sections of the side members 64, 66 are configured as a generally L-shape. Hook portions 152, 154 are provided for assuring the installation of the clamping bracket 54 to the transom 22 of the associated watercraft 24.

Figure 3:
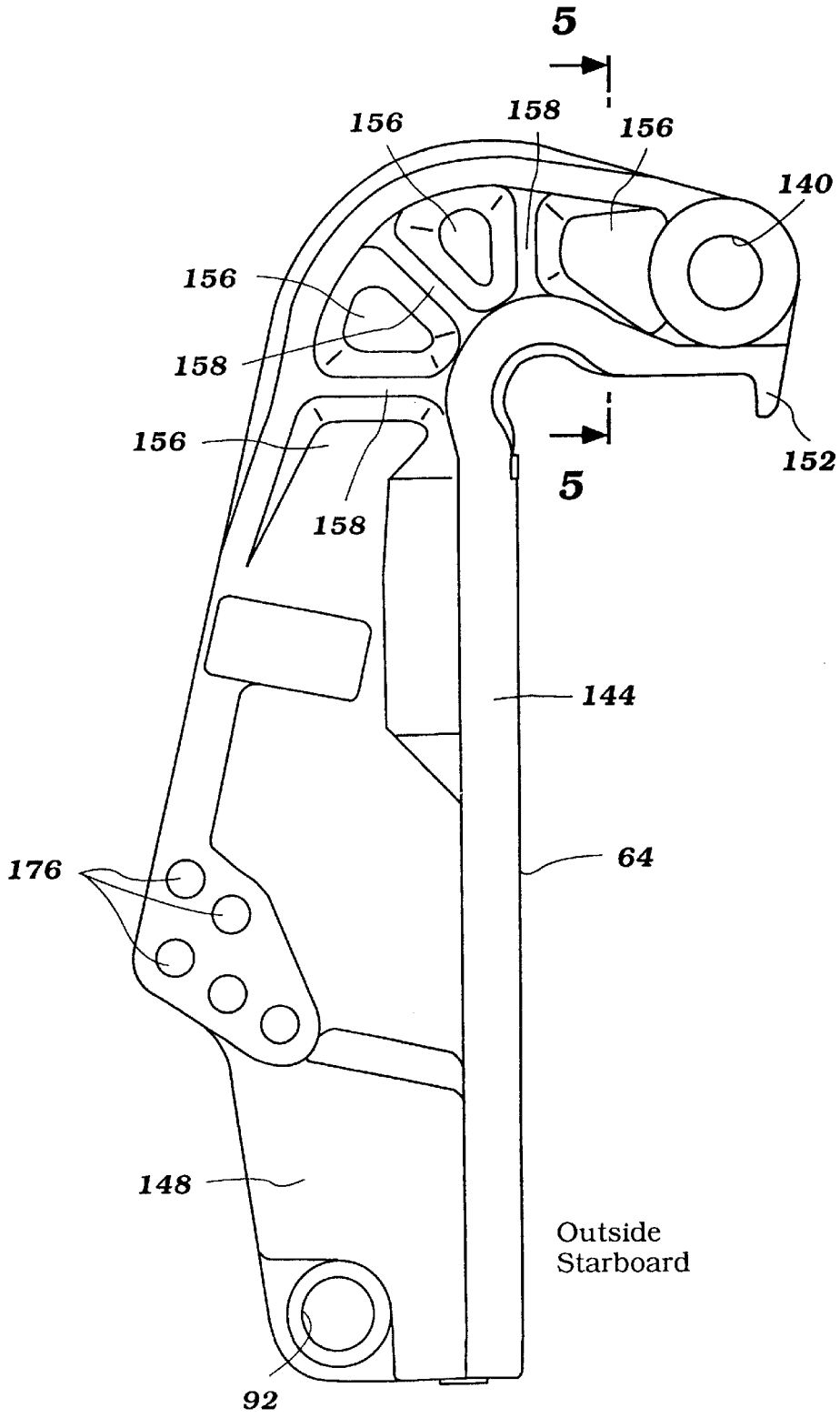
FIG. 3 is an enlarged outside elevational view of one clamping bracket member positioned at the starboard.
Figure 5:
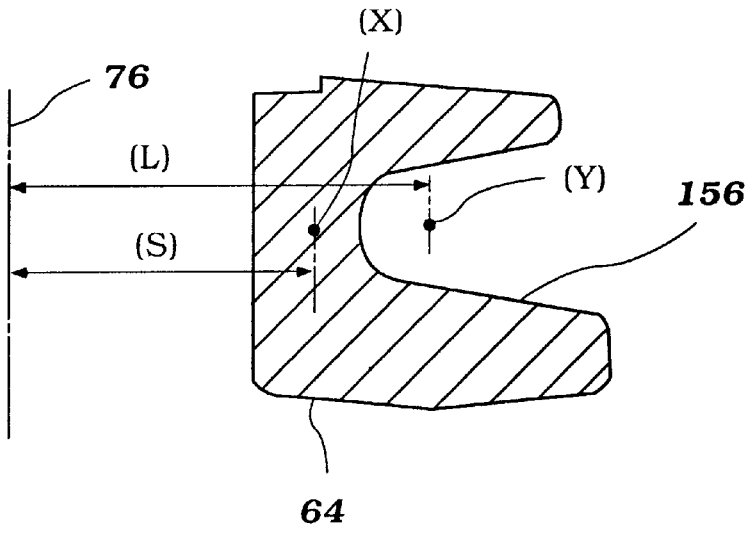
FIG. 5 is a cross-sectional view of the same clamping bracket member taken along the line 5—5 in FIG. 3.
Figure 6:
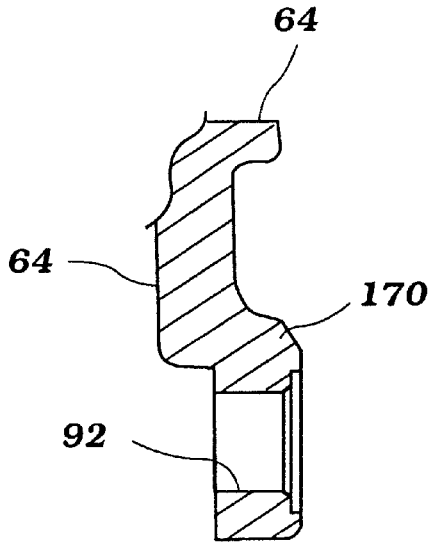
FIG. 6 is a cross-sectional view of the same clamping bracket member taken along the line 6—6 in FIG. 4.

As best seen in FIG. 3, the standing section 148 of the starboard side member 64 has hollow portions 156 that are recessed at the curved section. Ribs 158 are formed between the respective hollow portions 156. The hollow portions 156 open outwardly as seen in FIG. 5. The length distance (S) from the centroidal axis (X) of the starboard side member 64 proximate the hollow portions 156 to the point of action (Z) of the exerting force, which exists on the center axis 76, is less than the distance (L) from the centroidal axis (Y) of the starboard side member 64 in other locations to the same center axis 76 Accordingly, the bending moment exerted upon the side member 64 is smaller than the bending moment that would be produced if the hollow portions 156 were not provided. Thus, by decreasing the section modulus of the starboard side member 64, the maximum bending stress that can be accommodated is increased. This means that the starboard side member 64, particularly the curved portion thereof, is reinforced.

Figure 7:
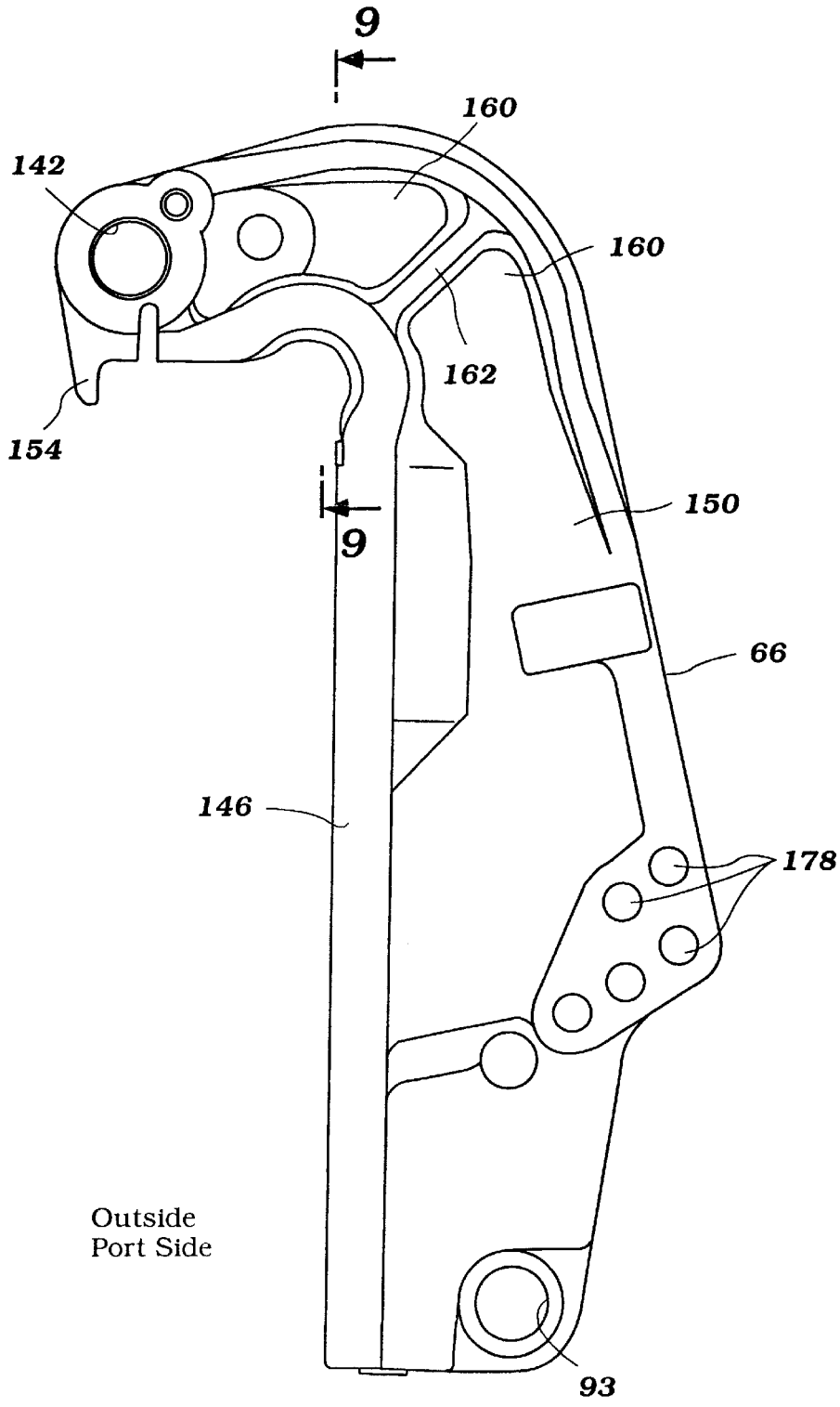
FIG. 7 is an enlarged outside elevational view of the other clamping bracket member positioned on the portside.
Figure 9:
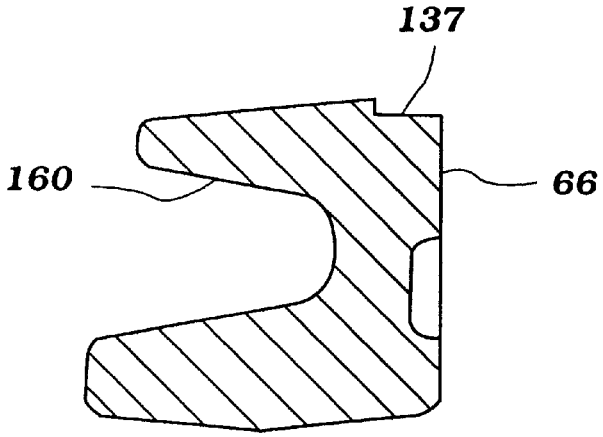
FIG. 9 is a cross-sectional view of the same clamping bracket member taken along the line 9—9 in FIG. 7.
Figure 10:
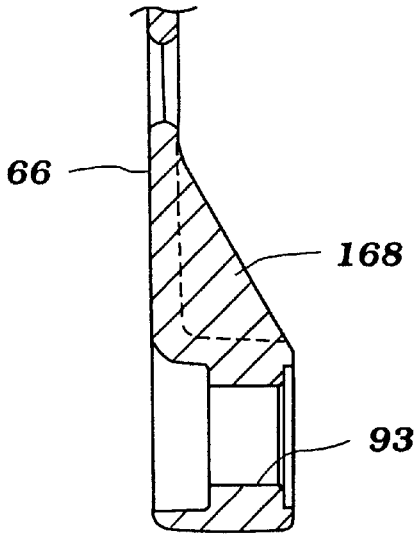
FIG. 10 is a cross-sectional view of the same clamping bracket member taken along the line 10—10 in FIG. 8.

In addition, as best seen in FIG. 7, the port side member 66 has only a couple of hollow portions 160, in other words, only one rib 162 therebetween. That is, the starboard side member 64 is reinforced greater than the port side member 66. Thus, the bending force exerted upon the starboard side member 64 is effectively absorbed by the multiple ribs 158 thereon. Conversely, the port side member 66 is lighter than the starboard side member 64 because it has no unnecessary reinforcement. The hollow portions 160 also open outwardly as shown in FIG. 9.

Figure 4:
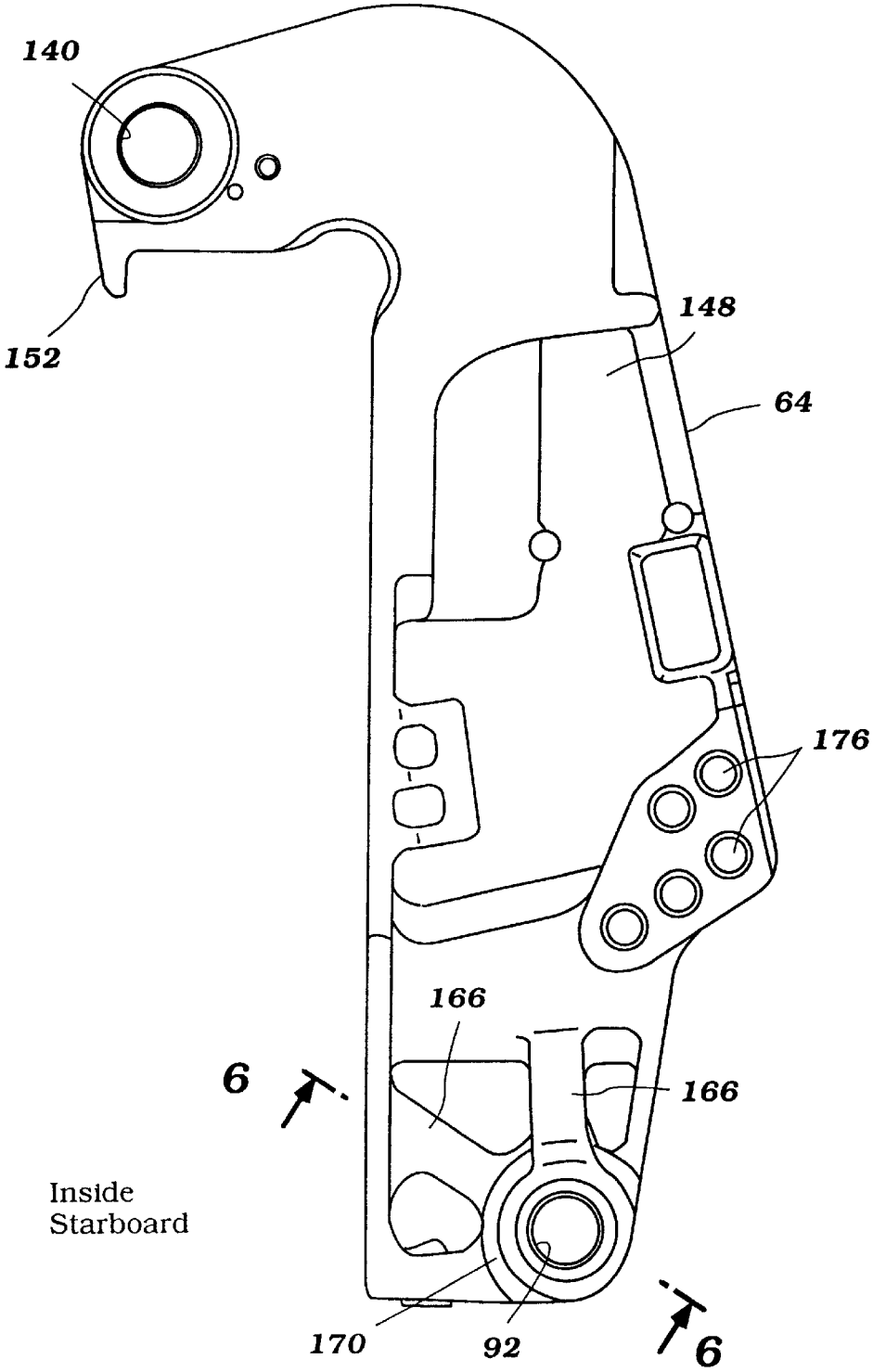
FIG. 4 is an enlarged inside elevational view of the same clamping bracket member as shown in FIG. 3.
Figure 8:
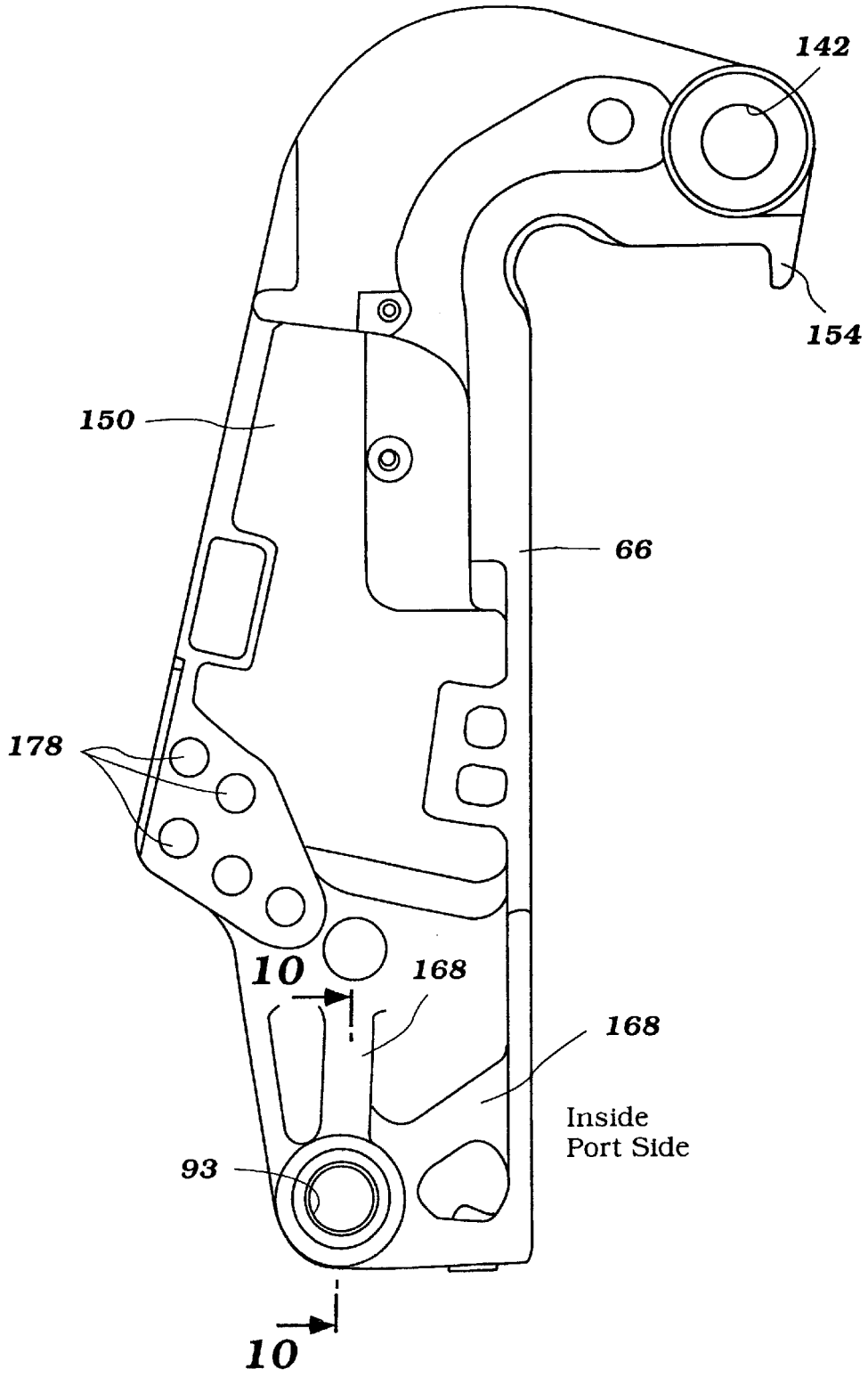
FIG. 8 is an enlarged inside elevational view of the same clamping bracket member as shown in FIG. 7.

In the meantime, the bottom portions of the standing sections 148, 150 are provided with the bores 92, 93 through which the lower pin 91 extends. As best seen in FIGS. 4 and 8, both portions in proximity to these bores 92, 93 are reinforced with a couple of ribs 166, 168. However, only the periphery of the bore 92 is further reinforced with a bank portion 170 formed around it. Accordingly, the bottom portion of the starboard side member 64 is more rigid than the same portion of the port side member 66.

As described above, in the bracket assembly 56, only the portions those substantially need reinforcement have configurations that increase rigidity. Thus, the reinforcement is achieved without increasing unnecessary weight.

A plurality of apertures or recesses 174 (see FIG. 2) are formed on the respective foot sections 144, 146 of the side members 64, 66. These apertures or recesses 174 are useful to reduce the whole weight of the clamping bracket 54 further.

Also, the respective standing sections 148, 150 have a plurality of apertures 176, 178 through which a trim stopper pin (not shown) will be inserted to keep the drive unit 58 at a suitable trim angle selectively and mechanically.

Of course, the foregoing description is that of a preferred embodiment of the invention, and various changes and modifications may be made without departing from the spirit and scope of the invention, as defined by the appended claims.

What is claimed is:

1. A tilt mechanism for a marine outboard drive comprising a swivel bracket carrying a drive unit for pivotal movement about a generally vertically extending steering axis, said swivel bracket having wall portions extending generally transversely at both sides of said steering axis, a clamping bracket supporting said swivel bracket for pivotal movement about a generally horizontally extending tilt axis, said clamping bracket having a pair of transversely spaced members adapted to be affixed to the transom of an associated watercraft, said wall portions of said swivel bracket at least partially being capable to be fitted between said transversely spaced members, a hydraulic cylinder assembly being capable to expand and contract along its longitudinal axis, said hydraulic cylinder assembly having a pair of end portions, one of said end portions being pivotally connected to said swivel bracket and the other one of said end portions being pivotally connected to said clamping bracket, said hydraulic cylinder assembly being biased to one of said transversely spaced members, and at least one of said wall portions and said transversely spaced members positioned nearer to said hydraulic cylinder assembly being reinforced greater than the other one of said wall portions and said transversely spaced members.

2. A tilt mechanism as set forth in claim 1 wherein the other one of said wall portions has a recess at its transverse end.

3. A tilt mechanism as set forth in claim 2 further comprising a tilt stop lever for supporting said drive unit at the fully tilted up position, and at least a part of said tilt stop lever being positioned at said recess.

4. A tilt mechanism as set forth in claim 1 wherein each one of said transversely spaced members includes a foot section being capable to be seated at the transom of the associated watercraft and a standing section extending from said foot section, and one of said standing sections positioned nearer to said hydraulic cylinder assembly is reinforced greater than the other one of said standing sections.

5. A tilt mechanism as set forth in claim 4 wherein both of said standing sections are provided with at least one rib, and the number of said ribs provided at said standing section positioned nearer to said hydraulic cylinder assembly is more than the number of said ribs provided at the other standing section.

6. A tilt mechanism as set forth in claim 5 wherein both sides of each of said ribs are formed as hollows opening toward generally outwardly.

7. A tilt mechanism as set forth in claim 4 wherein said respective standing sections have bores to receive a pivot shaft of said swivel bracket, and a portion located in proximity to said bore of said standing section positioned nearer to said hydraulic cylinder assembly is reinforced greater than another portion located in proximity to said bore of the other standing section.

8. A tilt mechanism as set forth in claim 7 wherein said respective portions are configured as curves.

9. A tilt mechanism as set forth in claim 4 wherein said respective standing sections have bores, a pivot shaft of the other one of said end portions of said hydraulic cylinder assembly is journaled in said bores, the other one of said end portions of said hydraulic cylinder assembly is disposed on said pivot shaft at generally directly next to one of said transversely spaced members, and the reminder of space on said pivot shaft is balanced with a collar.

10. A tilt mechanism as set forth in claim 1 further comprising a powering assembly for expanding and contracting said hydraulic cylinder assembly, and said powering assembly being disposed between said hydraulic cylinder assembly and one of said transversely spaced members that is positioned farther from said hydraulic cylinder assembly than the other one of said transversely spaced members.

11. A tilt mechanism for a marine outboard drive comprising a swivel bracket carrying a drive unit for pivotal movement about a generally vertically extending steering axis, a clamping bracket supporting said swivel bracket for pivotal movement about a generally horizontally extending tilt axis, said clamping bracket having a pair of transversely spaced members adapted to be affixed to the transom of an associated watercraft, a hydraulic cylinder assembly being capable to expand and contract along its longitudinal axis, said hydraulic cylinder assembly having a pair of end portions, one of said end portions being pivotally connected to said swivel bracket and the other one of said end portions being pivotally connected to said clamping bracket, said hydraulic cylinder assembly being disposed between said transversely spaced members and biased to one of said transversely spaced members, each of said transversely spaced members including a foot section being capable to be seated at the transom of the associated watercraft and a standing section extending from said foot portion, said respective standing sections having bores, a pivot shaft of the other one of said end portions of said hydraulic cylinder assembly being journaled in said bores, the other one of said end portions of said hydraulic cylinder assembly being disposed on said pivot shaft at generally directly next to one of said transversely spaced members, and the reminder of space on said pivot shaft being balanced with a collar.

* * * * *